US008542257B2

(12) United States Patent
An et al.

(10) Patent No.: US 8,542,257 B2
(45) Date of Patent: Sep. 24, 2013

(54) METHOD OF DRIVING A LIGHT SOURCE, APPARATUS FOR PERFORMING THE METHOD AND DISPLAY APPARATUS HAVING THE APPARATUS

(75) Inventors: Bo-Young An, Seoul (KR); Joo-Hyung Lee, Seoul (KR); Se-Byung Chae, Seoul (KR); Ho-Suk Maeng, Seoul (KR); Seung-Bin Moon, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 951 days.

(21) Appl. No.: 12/639,844

(22) Filed: Dec. 16, 2009

(65) Prior Publication Data

US 2010/0188434 A1 Jul. 29, 2010

(30) Foreign Application Priority Data

Jan. 23, 2009 (KR) ..... 10-2009-0006047

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS

2004/0246275 A1* 12/2004 Yoshihara et al. ..... 345/690
2008/0089604 A1* 4/2008 Kim et al. ..... 382/274
2009/0140973 A1* 6/2009 Kim et al. ..... 345/102

FOREIGN PATENT DOCUMENTS

KR 1020080002185 1/2008
KR 1020080039718 5/2008
KR 1020080065160 7/2008

OTHER PUBLICATIONS

English Abstract for Publication No. 1020080002185.
English Abstract for Publication No. 1020080039718.
English Abstract for Publication No. 1020080065160.

* cited by examiner

*Primary Examiner* — Joseph Haley
*Assistant Examiner* — Ifedayo Iluyomade
(74) *Attorney, Agent, or Firm* — F. Chau & Associates, LLC

(57) ABSTRACT

A light source apparatus includes a light source module, a luminance determiner, an illuminance sensor and a light source driver. The light source module provides a display panel with light. The luminance determiner obtains luminance data of first image data including at least white image data that is converted from image data of a red color, a green color and a blue color. The illuminance sensor obtains sensing data based upon an external illuminance. The light source driver drives the light source module based upon the luminance data and the sensing data.

20 Claims, 4 Drawing Sheets

METHOD OF DRIVING A LIGHT SOURCE, APPARATUS FOR PERFORMING THE METHOD AND DISPLAY APPARATUS HAVING THE APPARATUS

CROSS-REFERENCE TO RELATED APPLICATION

This application claims priority to and the benefit of Korean Patent Application No. 2009-6047, filed on Jan. 23, 2009 in the Korean Intellectual Property Office (KIPO), the entire content of which are incorporated by reference herein.

BACKGROUND

1. Field of the Invention

The present disclosure relates to display devices, and, more particularly, to a method of driving a light source, an apparatus for performing the method, and a display apparatus having the apparatus.

2. Discussion of the Related Art

Typically, liquid crystal display (LCD) devices, among the various types of flat panel display devices, have thinner thickness, lighter weight, lower driving voltage and lower power consumption, etc., as compared to other types of display devices, such as cathode ray tube (CRT) devices, plasma display panel (PDP) devices, and the like. As a result, LCD devices are being widely employed for various electronic devices such as monitors, laptop computers, cellular phones, large-size televisions, etc. An LCD device includes an LCD panel that displays an image using the light transmittance of liquid crystal molecules, and a backlight assembly that is disposed below the LCD panel to provide the LCD panel with light.

The LCD panel typically includes an array substrate, a color filter substrate and a liquid crystal layer. The array substrate includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate.

The backlight assembly may employ a plurality of cold cathode fluorescent lamps (CCFLs) as a light source. However, recently the backlight assembly has employed a plurality of light-emitting diodes (LEDs) having low power consumption and high color reproducibility.

Further, an LCD device has been developed that is capable of reducing power consumption by converting image data of red, green and blue image data into red, green, blue and white image data.

SUMMARY

Exemplary embodiments of the present invention provide a method of driving a light source capable of enhancing power efficiency.

Exemplary embodiments of the present invention also provide a light source apparatus for performing the above-mentioned method.

Exemplary embodiments of the present invention further also provide a display apparatus having the above-mentioned light source apparatus.

According to an exemplary embodiment of the present invention, there is provided a method of driving a light source. In the method, primary image data of a red color, a green color and a blue color is converted into first image data including at least white image data. Luminance data of the first image data is obtained. Sensing data is obtained based upon an external illuminance. A light source module providing a display panel with light is driven based upon the luminance data and the sensing data.

In an exemplary embodiment of the present invention, in driving the light source module, driving data may be obtained by multiplying the luminance data by the sensing data. Then, a driving signal having a pulse width may be generated based upon the driving data to provide the light source module with the driving signal having a pulse width.

In an exemplary embodiment of the present invention, in obtaining the driving data, a least significant bit of the driving data may be removed to obtain the amplitude of the driving data from the luminance data and the sensing data.

In an exemplary embodiment of the present invention, in obtaining the driving data, the driving data may be determined in accordance with an external input signal.

In an exemplary embodiment of the present invention, in determining the driving data, driving data of a minimum level may be maintained when the external input signal is no higher than driving data of the minimum level.

In an exemplary embodiment of the present invention, in obtaining the sensing data, at least one illuminance signal may be obtained by measuring an illuminance of an external environment. Then, illuminance data may be obtained by converting the illuminance signal from analog form to digital form. Then, a representative value of the illuminance data may be selected. Then, the sensing data corresponding to the representative value of the illuminance data may be obtained.

According to an exemplary embodiment of the present invention, a light source apparatus includes a light source module, a luminance determiner, an illuminance sensor and a light source driver. The light source module provides a display panel with light. The luminance determiner obtains luminance data of first image data including at least white image data that is converted from image data of a red color, a green color and a blue color. The illuminance sensor obtains sensing data based upon an external illuminance. The light source driver drives the light source module based upon the luminance data and the sensing data.

In an exemplary embodiment of the present invention, the light source driver may include a calculating unit and a pulse width generating unit. The calculating unit may obtain driving data by multiplying the luminance data by the sensing data. The pulse width generating unit may generate a driving signal having a pulse width based upon the driving data to provide the light source module with the driving signal having a pulse width.

In an exemplary embodiment of the present invention, the calculating unit may remove a least significant bit of the driving data in order to obtain the amplitude of the driving data from the luminance data and the sensing data.

In an exemplary embodiment of the present invention, the light source driver may further include a user adjusting unit determining the driving data in accordance with an external input signal.

In an exemplary embodiment of the present invention, the light source driver may further include a minimum level maintenance unit which maintains driving data of a minimum level when the external input signal is no higher than driving data of the minimum level.

In an exemplary embodiment of the present invention, the light source driver may further include a user adjusting unit determining the driving data in accordance with an external input signal.

In an exemplary embodiment of the present invention, the light source driver may further include a minimum level maintenance unit which maintains driving data of a minimum level when the external input signal is no higher than driving data of the minimum level.

In an exemplary embodiment of the present invention, the illuminance sensor may include a sensing unit, an analog-to-digital converter (ADC), a selection unit and a mapping unit. The sensing unit may obtain a plurality of illuminance signals by measuring an illuminance of an external environment. The ADC may convert the illuminance signal having analog value into illuminance data having digital value. The selection unit may select a representative value of the illuminance data. The mapping unit may output sensing data corresponding to the representative value of the illuminance data to the light source driver.

In an exemplary embodiment of the present invention, the illuminance sensor may further include a filtering unit removing a noise component of the illuminance data to provide the selection unit with the illuminance data in which a noise component is removed.

According to an exemplary embodiment of the present invention, a display apparatus includes a display panel, a panel driver and a light source apparatus. The display panel includes at least a white pixel. The panel driver may convert primary image data of a red color, a green color and a blue color into first image data including at least white image data to drive the display panel. The light source apparatus includes a light source module, a luminance determiner, an illuminance sensor and a light source driver. The light source module provides the display panel with light. The luminance determiner obtains luminance data of the first image data. The illuminance sensor obtains sensing data based upon an external illuminance. The light source driver drives the light source module based upon the luminance data and the sensing data.

In an exemplary embodiment of the present invention, the light source driver may include a calculating unit and a pulse width generating unit. The calculating unit may obtain driving data by multiplying the luminance data by the sensing data. The pulse width generating unit may generate a driving signal having a pulse width based upon the driving data to provide the light source module with the driving signal having a pulse width. The calculating unit may remove a least significant bit of the driving data to obtain the amplitude of the driving data from the luminance data and the sensing data. The illuminance sensor may include a sensing unit, an ADC, a selection unit and a mapping unit. The sensing unit may obtain a plurality of illuminance signals by measuring an illuminance of an external environment. The ADC may convert the illuminance signal having analog value into illuminance data having digital value. The selection unit may select a representative value of the illuminance data. The mapping unit may output sensing data corresponding to the representative value of the illuminance data to the light source driver.

In an exemplary embodiment of the present invention, the sensing unit may include at least one illuminance sensor mounted on the display panel.

According to exemplary embodiments of the present invention, primary image data of red, green and blue is converted into first image data including at least white image data to display the first image data on a display panel and a driving signal of a light source module providing the display panel with light, so that the luminance of a display apparatus may be increased and the power consumption of the display apparatus may be reduced.

BRIEF DESCRIPTION OF THE DRAWINGS

The exemplary embodiments of the present invention will now be described in detail with reference to the accompanying drawings, in which.

DETAILED DESCRIPTION OF THE EXEMPLARY EMBODIMENTS

Figure 1:
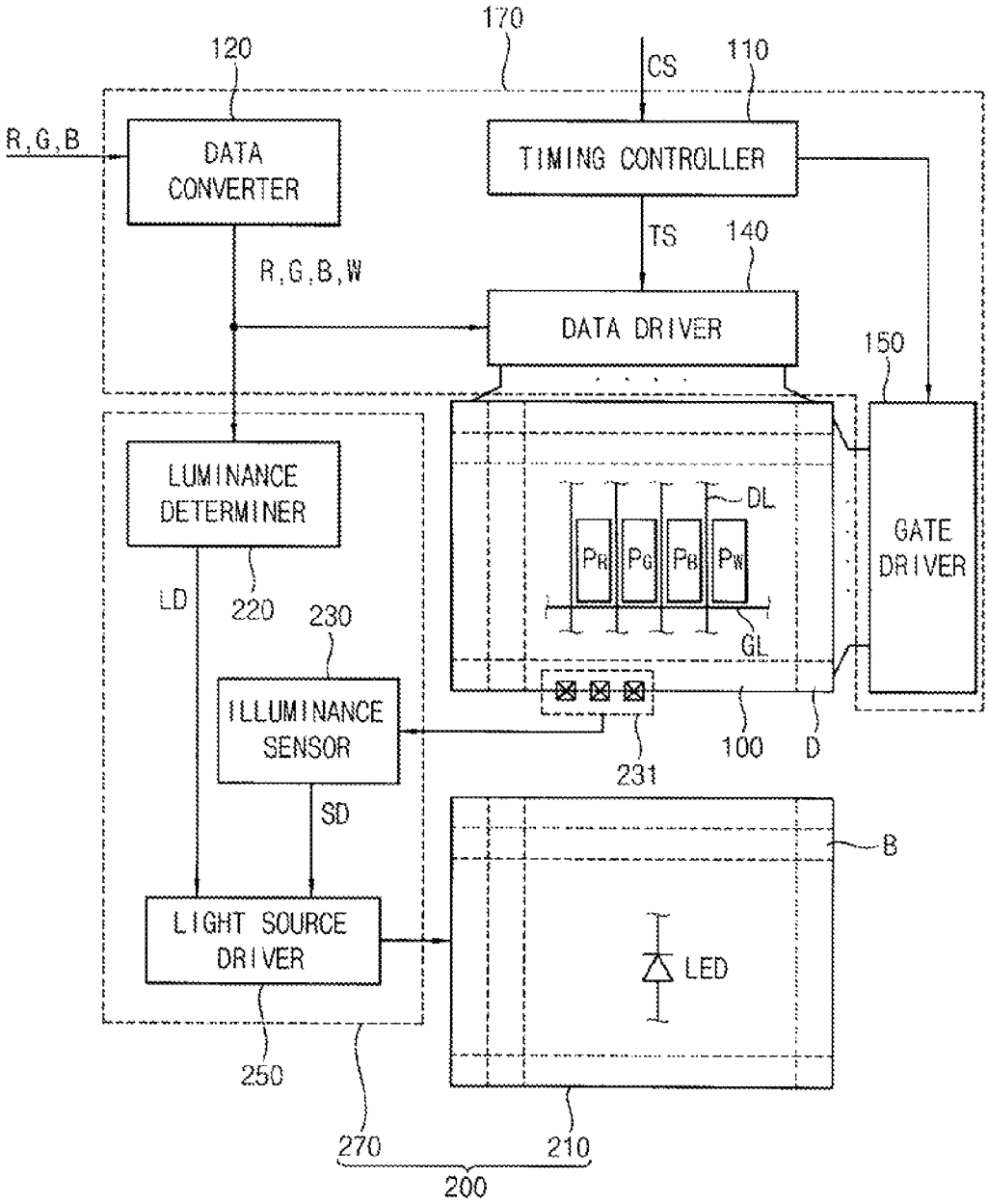
FIG. 1 is a block diagram illustrating a display apparatus according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. Like numerals refer to like elements throughout.

Referring now to FIG. 1, the display apparatus includes a display panel 100, a panel driver 170 and a light source apparatus 200.

The display panel 100 includes a plurality of data lines DL, a plurality of gate lines GL crossing the data lines DL, and a plurality of pixels electrically connected to the data lines DL and the gate lines GL. The pixels each include at least one white pixel. That is, each of the pixels includes a unit pixel including a red pixel $P_R$, a green pixel $P_G$, a blue pixel $P_B$ and a white pixel $P_w$. Each of the red, green, blue and white pixels includes a switching element (not shown) connected to a gate line GL and a data line DL, and a liquid crystal capacitor (not shown) and a storage capacitor (not shown) that are connected to the switching element.

The panel driver 170 includes a timing controller 110, a data converter 120, a data driver 140 and a gate driver 150.

The timing controller 110 receives a control signal CS from an external device (not shown). The control signal CS may include a vertical synchronizing signal (Vsync), a horizontal synchronizing signal (Hsync), and a data enable signal (DE). The vertical synchronizing signal (Vsync) represents a time required for displaying one frame. The horizontal synchronizing signal (Hsync) represents the time required for displaying one line of the frame. The data enable signal (DE) represents a time required for supplying the pixel with data.

The timing controller 110 generates a timing control signal TS which controls a driving timing of the display panel 100 by using the control signal CS. The timing control signal TS may include a clock signal, a horizontal start signal and a vertical start signal. The vertical start signal is provided to the gate driver 150 so as to sequentially activate a plurality of gate lines of the panel driver 170.

The data converter 120 converts primary image data of red, green and blue image data received from an external device (not shown) in correspondence with the red, green, blue and white image pixels $P_R$, $P_G$, $P_B$ and $P_W$ of the display panel 100. That is, the data converter 120 converts the primary image data of a red color, a green color and a blue color that are received from an external device into first image data including at least white image data. In an exemplary embodiment, the data converter 120 converts the primary image data into the first image data including red, green, blue and white image data. The data converter 120 provides the data driver 140 and the light source driving apparatus 200 with the first image data.

The data driver 140 provides the data line DL with a data voltage by using a data control signal received from the timing controller 110 and the first image data received from the data converter 120. That is, the data driver 140 converts the first image data into an analog data voltage, and outputs the analog data voltage to the data line DL.

The gate driver 150 drives the gate line GL by using a gate control signal received from the timing controller 110. In an exemplary embodiment the gate driver 150 sequentially provides the gate lines GL with a gate signal to activate the gate line GL.

The light source driving apparatus 200 includes a light source module 210 and a light source module driver 270.

The light source module 210 includes at least one light source. The light source module 210 is divided into I×J ('I' and 'J' are natural numbers) light-emitting blocks B. The light-emitting block B are individually driven, which corresponds to an image displayed on the display panel 100, in accordance with a local dimming method. Each of the light-emitting blocks B includes a plurality of white light sources. Alternatively, each of the light-emitting blocks B may include a plurality of red light sources, a plurality of green light sources and a plurality of blue light sources. The at least one light source is an LED.

The light source module driver 270 includes a luminance determiner 220, an illuminance sensor 230 and a light source driver 250.

The luminance determiner 220 obtains luminance data LD from the first image data provided from the data converter 120. The luminance data LD is output by a frame of an image. The luminance determiner 220 provides the light source driver 250 with the luminance data LD.

The light source module driver 270 obtains sensing data SD based upon illuminance signals corresponding to an illuminance of an external environment which is measured by a sensor unit 231 adjacent to the display panel 100. The illuminance sensor 230 provides the light source driver 250 with the sensing data SD. A detailed description of the illuminance sensor 230 will be described more fully hereinafter with reference to FIGS. 2 and 3.

The light source driver 250 drives the light source module 210 based upon the luminance data LD provided from the luminance determiner 220 and the sensing data SD provided from the illuminance sensor 230. A detailed description of the light source driver 250 will be described more fully hereinafter with reference to FIG. 4.

Figure 2:
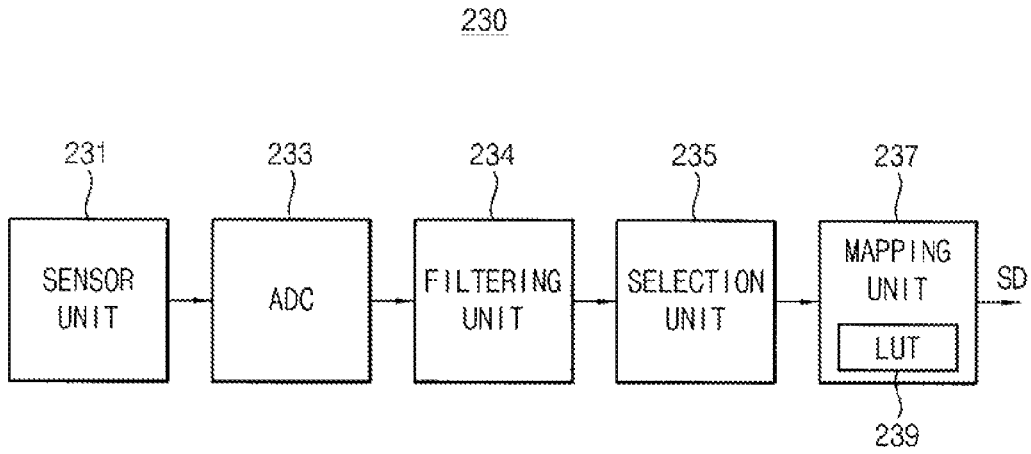
FIG. 2 is a block diagram illustrating the illuminance sensor of FIG. 1.
Figure 3:
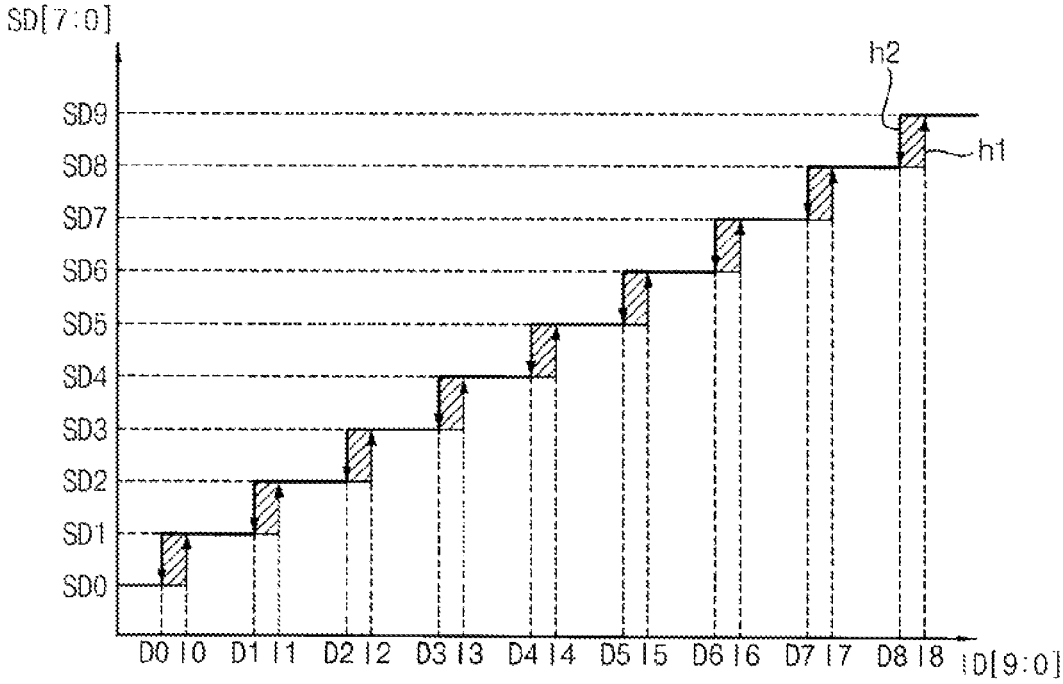
FIG. 3 is a graph showing one example of the lookup table (LUT) of FIG. 2.

FIG. 2 is a block diagram illustrating an illuminance sensor 230 of FIG. 1. FIG. 3 is a graph showing one example of an LUT 239 of FIG. 2.

Referring to FIGS. 2 and 3, the illuminance sensor 230 includes a sensing unit 231, an analog to digital converter 233 (hereinafter ADC refers to the analog to digital converter), a selection unit 235 and a mapping unit 237. In the exemplary embodiment the illuminance sensor 230 further includes a filtering unit 234.

The sensing unit 231 measures an illuminance of an external environment to obtain illuminance signals, and outputs the illuminance signals to the ADC 233. The sensing unit 231 includes at least one illuminance sensor that is mounted on the display panel 100 of the display apparatus (see FIG. 1). The sensing unit 231 may further include a temperature compensation sensor. In an exemplary embodiment, the illuminance sensor 230 is mounted on the display panel 100 of the display apparatus. However, the position of an illuminance sensor 230 is not limited thereto. That is, the illuminance sensor may be disposed at various positions at which an illuminance of an external environment can be measured in a display apparatus.

The ADC 233 obtains illuminance data by converting the illuminance signals into digital illuminance data. The illuminance sensor 230 further includes a filtering unit 234 which removes a noise component from the illuminance data.

The selection unit 235 selects a representative value of illuminance data that is output from the filtering unit 234. When the filtering unit 234 is omitted from the illuminance sensor 230, the selection unit 235 selects the representative value of the illuminance data that is output from the ADC 233. In an exemplary embodiment, the representative value can be one of the illuminance data. In an exemplary embodiment, the representative value can be an average value of the illuminance data.

The mapping unit 237 provides the light source driver 250 with sensing data SD corresponding to the representative value of the illuminance data. The mapping unit 237 includes an LUT 239 in which illuminance data and information of sensing data corresponding to the illuminance data are stored. As shown in FIG. 3, the sensing data, which corresponds to the illuminance data that is stored in the LUT 239, has a hysteretic characteristic.

Referring to FIG. 3, the x-axis represents illuminance data ID, and the y-axis represents sensing data SD corresponding to the illuminance data ID. In an exemplary embodiment, the illuminance data ID is 10-bit data and the sensing data SD is 8-bit data. In FIG. 3, I0, I1, I2, I3, I4, I5, I6, I7 and I8 are illuminance data ID when illuminance data ID are increased, and D0, D1, D2, D3, D4, D5, D6, D7 and D8 are illuminance data when the illuminance data ID is decreased.

In FIG. 3, an increasing line 'h1' in a stepped shape in accordance with I0 to I8 shows sensing data SD corresponding to I0 to I8 when illuminance data ID are increased, and a decreasing line 'h2' in a stepped shape in accordance with D0 to D8 shows sensing data SD corresponding to D0 to D8 when illuminance data ID is decreased. As shown in FIG. 3, the LUT 239 has a portion of increased illuminance data ID and a portion of decreased illuminance data ID overlapped with each other at a boundary of the sensing data SD. That is for maintaining a current state at a predetermined area so as to prevent flicker from being generated when an external illuminance is finely varied. For example, overlapping of increased illuminance data and decreased illuminance data is shown by the arrow head and tail of a particular D/I pairing (e.g., arrow head D2 and tail I2) at a boundary (e.g., level SD2).

Figure 4:
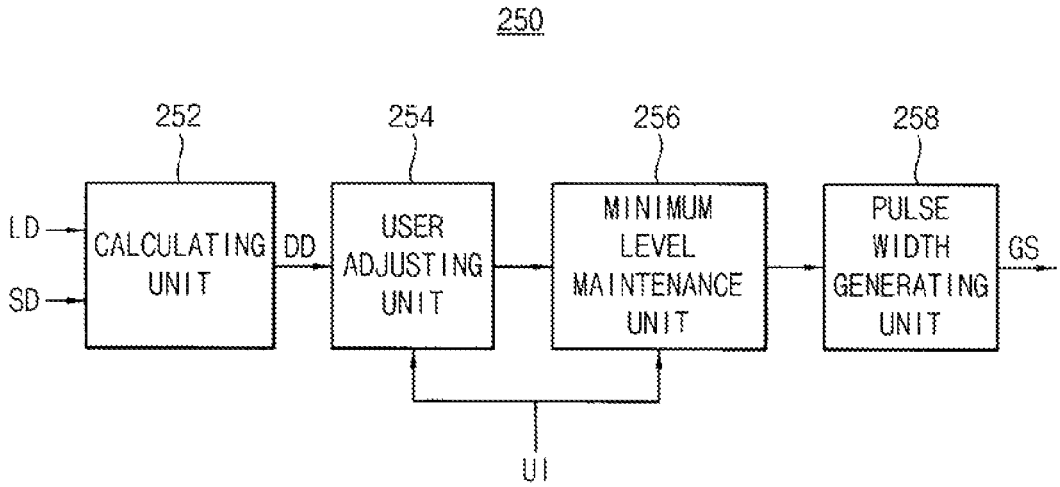
FIG. 4 is a block diagram illustrating the light source driver of FIG. 1.

FIG. 4 is a block diagram illustrating a light source driver 250 of FIG. 1. The light source driver 250 includes a calculating unit 252 and a pulse width generating unit 258.

The calculating unit 252 multiplies the luminance data LD provided from the luminance determiner 220 by the sensing data SD provided from the illuminance sensor 230 and outputs driving data DD. The calculating unit 252 removes a least significant bit of the driving data, so that the amplitude of the luminance data LD may be substantially equal to that of the sensing data. The calculating unit 252 provides the pulse width generating unit 258 with the driving data DD.

The pulse width generating unit 258 generates a driving signal GS having a pulse width based upon driving data DD provided from the calculating part 252. The pulse width generating part 258 provides the light source module 210 with the generated driving signal GS to drive the light source module 210.

The light source driver 250 further includes a user adjusting unit 254 between the calculating unit 252 and the pulse width generating unit 258.

In an exemplary embodiment the user adjusting unit 254 preferentially determines the driving data DD in accordance with an input signal UI provided from an external device. For example, the user adjusting unit 254 may be connected to an external keyboard to output the driving data DD for adjusting the luminance of a display apparatus in accordance with the input signal UI that is input in accordance with an operation of the user.

The light source driver further includes a minimum level maintenance unit 256 disposed between the user adjusting unit 254 and the pulse width generating unit 258.

The minimum level maintenance unit 256 maintains driving data DD of a minimum level when the input signal UI is no higher than driving data of the minimum level. Thus, the minimum level maintenance unit 256 provides a minimum luminance needed for displaying of the display apparatus.

The display apparatus in accordance with an exemplary embodiment of the present invention includes a display panel 100 having a unit pixel on which a red pixel $P_R$, a green pixel $P_G$, a blue pixel $P_B$ and a white pixel $P_W$ are formed. The display apparatus converts primary image data of red, green and blue data that is provided from an external device so as to display an image, and provides the converted image data to the display panel 100. The above technology will be referred to as PenTile® technology, where PenTile is a registered trademark of Clairvoyante.

In the PenTile® technology, a plurality of white pixels $P_W$ is further included in a display apparatus, so that a luminance can be obtained by about 200% in comparison with a conventional display apparatus which only uses red, green and blue pixels $P_R$, $P_G$ and $P_B$. Thus, when PenTile® technology is employed in the display apparatus to be adjusted so as to obtain the luminance of about 100%, so that the power consumption of a light source providing the display panel 100 with light can be reduced by about 50% so that power consumption can be enhanced.

Moreover, the PenTile® technology can be employed in the display apparatus and luminance thereof additionally adjusted in accordance with an external illuminance, so that the power consumption of the display apparatus can be even more reduced.

Figure 5:
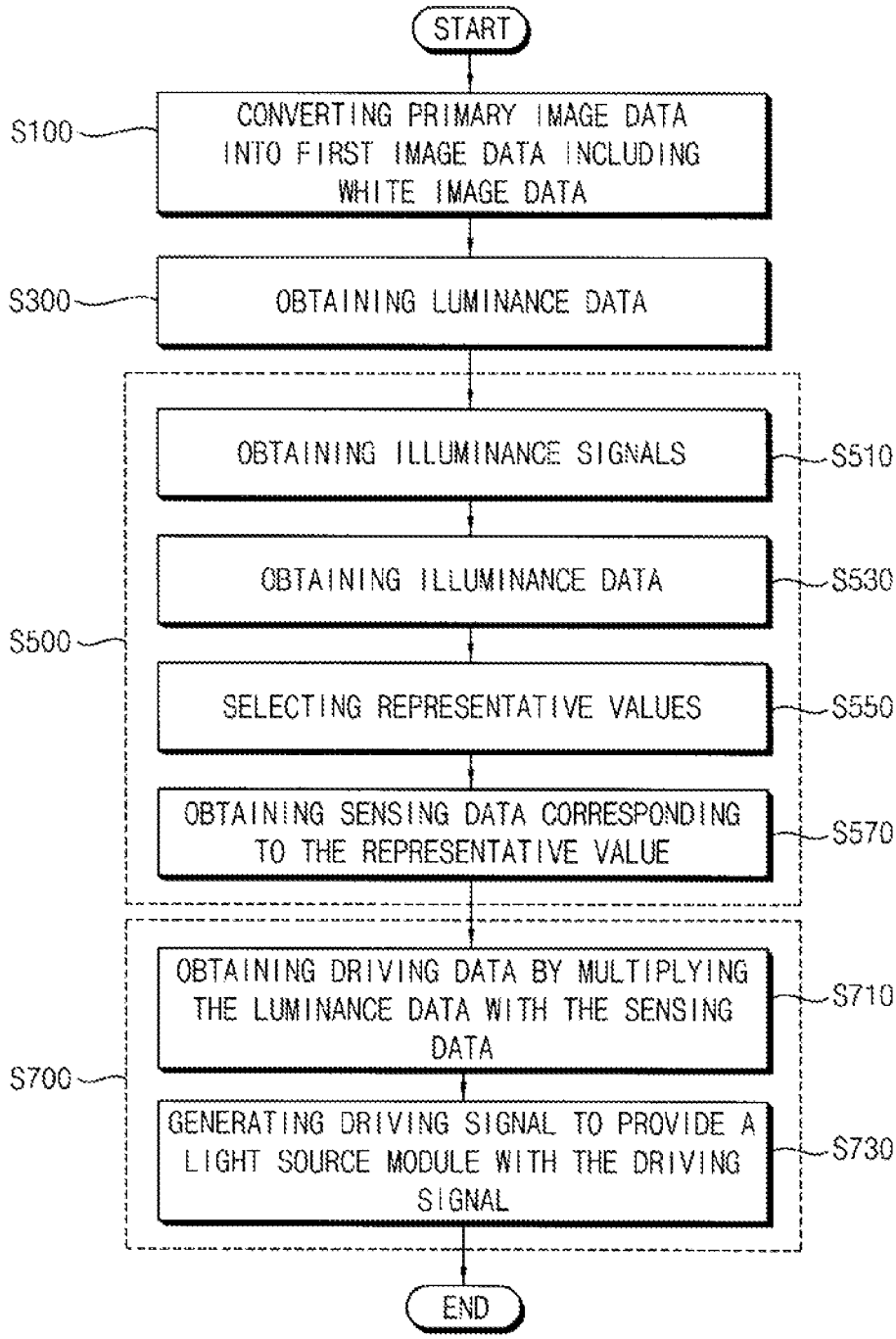
FIG. 5 is a flowchart showing a method of driving a light source according to an exemplary embodiment of the present invention.

FIG. 5 is a flowchart showing a method of driving a light source according to an exemplary embodiment of the present invention.

Referring to FIGS. 1 to 5, the data converter 120 converts primary image data of a red color, a green color and a blue color into first image data including at least white image data (step S100). The luminance determiner 220 obtains luminance data LD from the first image data that are provided from the data converter 120 (step S300). The luminance data LD may be outputted by one frame. The luminance data LD that is output from the luminance determiner 220 is provided to the light source driver 250.

A plurality of illuminance signals corresponding to an exterior environment, which is measured by the sensor part 231 adjacent to the display panel 100, is obtained as sensing data SD by the illuminance sensor 230 (step S500). The sensing data SD that is output from the illuminance sensor 230 is provided to the light source driver 250.

In step 5500, the sensor part 231 measures an external illuminance to output illuminance signals (step S510). The sensor part 231 includes at least one illuminance sensor that is mounted on the display panel 100. The sensor part 231 may further include a temperature compensation sensor. In an exemplary embodiment, the illuminance sensor is mounted on the display panel 100 of the display apparatus. However, the position of the illuminance sensor is not limited to the exemplary embodiment. That is, a disposed position of the illuminance sensor can be placed at any position where an external illuminance of the display apparatus is measured.

The illuminance signals are digitally converted by the ADC 233 so that digital illuminance data is output (step S530). Moreover, filtering the digitally converted illuminance data through a filter unit 234 may be further included in step S530.

A representative value of the illuminance data that is output from the ADC 233 is selected by the selection part 235 (step S550). In an exemplary embodiment, the representative value of the illuminance data can be one of the illuminance data. In an exemplary embodiment, the representative value of the illuminance data can be an average value of the illuminance data.

Sensing data SD corresponding to the representative value of the illuminance data is output from the mapping unit 237 to be provided to the light source driver 250 (step S570). The mapping unit 237 includes an LUT 239 in which illuminance data and information of sensing data corresponding to the illuminance data are stored. As shown in FIG. 3, the sensing data, which corresponds to the illuminance data that is stored in the LUT 239, has a hysteretic characteristic. To prevent flicker from being generated when an external illuminance is finely varied, the LUT 239 has a portion of increased illuminance data ID and a portion of decreased illuminance data ID that are overlapped with each other at a boundary of the sensing data SD.

The light source driver 250 drives the light source module 210 which provides the display panel with light, based upon the luminance data LD provided from the luminance determiner 220 and the sensing data SD provided from the illuminance sensor 230 (step S700).

In step S700, the luminance data LD provided from the luminance determiner 220 and the sensing data SD provided from the illuminance sensor 230 are multiplied by the calculating unit 252 to be output as driving data (step S710). A least significant bit of the driving data is removed, so that the amplitude of the luminance data LD is substantially equal to that of the sensing data SD. In step 5710, preferentially determining the driving data may be further performed in accordance with an input of an external device (not shown). For example, the luminance of the display apparatus may be adjusted in accordance with an input of a user through an external keypad connected to the user adjusting unit 254. Moreover, when an external input corresponding to no higher than driving data of a minimum level is applied to the user adjusting unit 254, maintaining driving data of the minimum level may further be performed. For example, a minimum luminance required for driving the display apparatus may be maintained by the minimum level maintenance unit 256.

Driving data provided from the calculating unit 252 is converted as a driving signal having a pulse width by the pulse width generating unit 258 (step S730). The pulse width generating unit 258 provides the light source module 210 with the converted driving signal, so that the light source module 210 is driven.

As described above, since PenTile® technology which obtains the luminance of about 200% in comparison with a conventional display apparatus is employed in the display apparatus of the present invention, the luminance of the display apparatus can be additionally adjusted so that the power consumption of the display apparatus can be enhanced.

As described above, according to the embodiments of the present invention, a unit pixel of red, green, blue and white pixels $P_R$, $P_G$, $P_B$ and $P_W$ is used in a display apparatus, so that the luminance of the display can be increased by about 200% in comparison with a conventional display apparatus. Moreover, the luminance of the display apparatus can be further adjusted in accordance with a variation of an external illuminance, so that the luminance of the display apparatus can be increased. Furthermore, the power consumption of the display apparatus can be reduced.

Although exemplary embodiments of the present invention have been described, those skilled in the art will readily appreciate that many modifications are possible and are intended to be included within the scope of the present invention as defined in the following claims.

What is claimed is:

1. A method of driving a light source, the method comprising:

converting primary image data of a red color, a green color and a blue color into first image data including at least white image data;

obtaining luminance data of the first image data;

mapping external illuminance data to obtain sensing data using a lookup table configured to overlap increased external illuminance data with decreased external illuminance data for preventing flicker; and driving a light source module that provides a display panel with light based upon the luminance data and the sensing data.

2. The method of claim 1, wherein driving a light source module comprises:

obtaining driving data by multiplying the luminance data by the sensing data; and generating a driving signal having a pulse width based upon the driving data to provide the light source module with the driving signal having a pulse width.

3. A method of driving a light source, the method comprising:

converting primary image data of a red color, a green color and a blue color into first image data including at least white image data;

obtaining luminance data of the first image data;

obtaining sensing data based upon an external illuminance; and driving a light source module that provides a display panel with light based upon the luminance data and the sensing data, wherein driving a light source module comprises:

obtaining driving data by multiplying the luminance data by the sensing data; and generating a driving signal having a pulse width based upon the driving data to provide the light source module with the driving signal having a pulse width, and wherein obtaining the driving data comprises:

removing a least significant bit of the driving data such that the amplitude of the driving data is obtained from the luminance data and the sensing data.

4. The method of claim 2, wherein obtaining the driving data comprises:

determining the driving data in accordance with an external input signal.

5. The method of claim 4, wherein determining the driving data further comprises:

maintaining driving data of a minimum level when the external input signal is lower than driving data of the minimum level.

6. The method of claim 1, wherein obtaining the sensing data comprises:

obtaining at least one illuminance signal by measuring an illuminance of an external environment;

converting the at least one illuminance signal having analog value to illuminance data having digital value;

selecting a representative value of the illuminance data; and obtaining the sensing data corresponding to the representative value of the illuminance data.

7. A light source apparatus comprising:

a light source module that provides a display panel with light;

a luminance determiner that obtains luminance data of first image data that includes at least white image data that is converted from image data of a red color, a green color and a blue color;

an illuminance sensor that obtains sensing data based upon an external illuminance; and a light source driver that drives the light source module based upon the luminance data and the sensing data, wherein the illuminance sensor comprises a lookup table configured to overlap increased external illuminance data with decreased external illuminance data for preventing flicker when mapping the sensing data based upon the external illuminance.

8. The light source apparatus of claim 7, wherein the light source driver comprises:

a calculating unit that obtains driving data by multiplying the luminance data by the sensing data; and a pulse width generating unit that generates a driving signal having a pulse width based upon the driving data to provide the light source module with the driving signal having a pulse width.

9. A light source apparatus comprising:

a light source module that provides a display panel with light;

a luminance determiner that obtains luminance data of first image data that includes at least white image data that is converted from image data of a red color, a green color and a blue color;

an illuminance sensor that obtains sensing data based upon an external illuminance; and a light source driver that drives the light source module based upon the luminance data and the sensing data, wherein the light source driver comprises:

a calculating unit that obtains driving data by multiplying the luminance data by the sensing data; and a pulse width generating unit that generates a driving signal having a pulse width based upon the driving data to provide the light source module with the driving signal having a pulse width, and wherein the calculating unit is configured to remove a least significant bit of the driving data to obtain the amplitude of the driving data from the luminance data and the sensing data.

10. The light source apparatus of claim 8, wherein the light source driver further comprises a user adjusting unit that determines the driving data in accordance with an external input signal.

11. The light source apparatus of claim 10, wherein the light source driver further comprises a minimum level maintenance unit that maintains driving data of a minimum level when the external input signal is no higher than driving data of the minimum level.

12. The light source apparatus of claim 9, wherein the light source driver further comprises a user adjusting unit that determines the driving data in accordance with an external input signal.

13. The light source apparatus of claim 12, wherein the light source driver further comprises a minimum level maintenance unit that maintains driving data of a minimum level when the external input signal is no higher than driving data of the minimum level.

14. The light source apparatus of claim 7, wherein the illuminance sensor comprises:

a sensing unit that obtains a plurality of illuminance signals by measuring an illuminance of an external environment;

an analog-to-digital converter that converts the illuminance signal having analog value into illuminance data having digital value;

a selection unit that selects a representative value of the illuminance data; and a mapping unit that outputs to the light source driver sensing data corresponding to the representative value of the illuminance data.

15. The light source apparatus of claim 14, wherein the illuminance sensor further comprises:

a filtering unit that removes a noise component of the illuminance data to provide the selection unit with the illuminance data in which a noise component is removed.

16. A display apparatus comprising:

a display panel comprising at least a white pixel;

a panel driver that converts primary image data of a red color, a green color and a blue color into first image data including at least white image data to drive the display panel; and a light source apparatus comprising:

a light source module that provides the display panel with light;

a luminance determiner that obtains luminance data of the first image data;

an illuminance sensor that obtains sensing data based upon an external illuminance; and a light source driver that drives the light source module based upon the luminance data and the sensing data, wherein the illuminance sensor comprises a lookup table configured to overlap increased external illuminance data with decreased external illuminance data for preventing flicker when mapping the sensing data based upon the external illuminance.

17. The display apparatus of claim 16, wherein the light source driver comprises:

a calculating unit that obtains driving data by multiplying the luminance data by the sensing data; and a pulse width generating unit that generates a driving signal having a pulse width based upon the driving data to provide the light source module with the driving signal having a pulse width.

18. A display apparatus comprising:

a display panel comprising at least a white pixel;

a panel driver that converts primary image data of a red color, a green color and a blue color into first image data including at least white image data to drive the display panel; and a light source apparatus comprising:

a light source module that provides the display panel with light;

a luminance determiner that obtains luminance data of the first image data;

an illuminance sensor that obtains sensing data based upon an external illuminance; and a light source driver that drives the light source module based upon the luminance data and the sensing data, wherein the light source driver comprises:

a calculating unit that obtains driving data by multiplying the luminance data by the sensing data and a pulse width generating unit that generates a driving signal having a pulse width based upon the driving data to provide the light source module with the driving signal having a pulse width, and wherein the calculating unit removes a least significant bit of the driving data to obtain the amplitude of the driving data from the luminance data and the sensing data.

19. The display apparatus of claim 17, wherein the illuminance sensor comprises:

a sensing unit that obtains a plurality of illuminance signals by measuring an illuminance of an external environment;

an analog-to-digital converter that converts the illuminance signal having into illuminance data having digital value;

a selection unit that selects a representative value of the illuminance data; and a mapping unit that includes the lookup table and that outputs sensing data corresponding to the representative value of the illuminance data to the light source driver.

20. The display apparatus of claim 19, wherein the sensing unit comprises at least one illuminance sensor mounted on the display panel.

* * * * *